United States Patent [19]

Rotunda

[11] 4,229,742

[45] Oct. 21, 1980

[54] CUBICLE QUAD ANTENNA

[76] Inventor: Orlando Rotunda, 2132 - 21st Ave., Greeley, Colo. 80631

[21] Appl. No.: 49,130

[22] Filed: Jun. 18, 1979

[51] Int. Cl.[3] ..... H01Q 1/16; H01Q 7/00

[52] U.S. Cl. ..... 343/742; 343/871

[58] Field of Search ..... 343/742, 743, 744, 819, 343/868, 871, 882

[56] References Cited

U.S. PATENT DOCUMENTS

| | | | |
|---|---|---|---|
| 2,419,673 | 4/1947 | Busignies et al. | 343/871 |
| 2,559,149 | 7/1951 | Ercolino | 343/882 |
| 3,532,315 | 10/1970 | Partridge | 343/742 |
| 4,138,682 | 2/1979 | Doherty | 343/871 |

*Primary Examiner*—Eli Lieberman

*Attorney, Agent, or Firm*—Wilbur A. E. Mitchell

[57] ABSTRACT

A Cubicle Quad antenna having radial spider arms on a boom, a plurality of wire elements on each spider arm, with each element encased in a non-conductive material rod, and a ball-and-socket joint at each corner of each element-rod where it is secured onto a spider arm, so as to permit a wind or weather caused movement of the antenna and its element-rods without causing a breaking of a wire element at each corner thereof.

3 Claims, 7 Drawing Figures

CUBICLE QUAD ANTENNA

BACKGROUND OF THE INVENTION

This invention relates to outdoor antennas in general, and more particularly to Cubicle Quad antennas.

This invention is an improvement of an antenna, of its traditional cubicle band attachment physical construction, to eliminate weakness and assure prolonged use, by providing a pivotal connection of the element-rod wires of each element portion to the spoke arms of the antenna spider, for permitting wind caused movement of the entire antenna without breaking the loop wires at the corner connection points. Each quad one-quarter wire band is conventionally fiberglass embedded as a rod.

The total length of the copper wire elements of a Cubicle Quad antenna conventionally represents one full wavelength at operating frequency. In use, its physical dimensions increase as its operating frequency is lowered. Seldom are Cubicle Quad antennas used in the frequency range below 14 MHZ., for that reason. Each side of the quad is cut to one-quarter of a wavelength, or approximately 17 feet, depending upon the exact part of the spectrum to which the antenna is tuned. The entire antenna is constructed of a minimum weight material consistant to have reasonable strength, in view of its large size. Yet adequate rigidity is necessary to be able to withstand high winds and thus necessarily limits its use. It would be an impractical array to be installed of heavy material and mast rotated due to that weight. The spider arms are usually made of bamboo or fiberglass lightweight material, being in turn secured to a horizontal central boom of a mast. The mast is usually rotatable.

Cubicle Quad antennas have been superior to Yagi array and verticle whip-type system antennas, both as to radio frequency radiation and receiving characteristics, due to the basic design of a Cubicle Quad antenna with both its horizontal polarized and vertically polarized wave patterns, with reference to the earth, thereby minimizing the condition of "selective fading." Also, the Cubicle Quad antenna has more efficiently radiated energy into a relatively narrow and shallow shaft, and when used as a receiving antenna it has eliminated the reception of radio signals better than the random direction radiation of the prior style Yagi and whip-type antennas. Another benefit of the Cubicle Quad antenna is its lack of high current discharge points, since its high current discharge points occur in the center of its wire elements between its quad box-like corners, and there is therefore no "launching point." Whereas in the case of Yagi and other style antennas, the high current discharge points occur at the tips of the elements of its wire array.

One of the conventional quad elements is a reflector, another is the driven and the third is the director. While the cubicle box-like quad antenna is superior in electrical benefits, over the conventional Yagi and whip-type systems, it has been found heretofore to have a physical characteristic defect. Namely, the wire quad elements at each of its box-like corners break in time from wind caused vibration in use. Heavy wind and weather causes the entire antenna parts to be moved and wracked in various directions.

As far as known, before Applicant's invention, there never has been a Cubicle Quad antenna of box-like construction of a plurality of quad wire elements wherein each corner was secured to the spider arms by a ball-and-socket pivot joint connection.

SUMMARY OF THE INVENTION

This invention relates to Cubicle outdoor Quad antennas of box-like construction, wherein there are quad elements on the spider arms thereof. More particularly this invention provides a novel ball-and-socket joint connection means for each quad wire fiberglass encased cubicle elements, at its corners where it is fastened onto its spider arms. I use a flexible wire braid extension around those ball-and-socket corner connections to provide good electrical continuity for each such rod band. Those braided connections prevent a breaking thereof and of the circuit at each corner, as the Cubicle Quad element of the antenna moves or is wracked by such as wind pressure.

I provide a novel pivot connection corner element structure. The four individual one-quarter wave length copper wire elements are each encased in about a 3/16ths inch hollow rod of fiberglass, so that each wire terminates at each end of its rod in a ball-and-socket novel connection arrangement. I secure a ball to each end of each fiberglass-wire rod, and I attach a sockets to the spider arm. That structure permits a flexing, without wire fatigue and resultant wire breakage, at those pivot connections from wind caused movement of the entire antenna. The flexible braided copper wire at the end of each element connects each one-quarter element across a corner to the wire of the adjacent one.

It is therefore a principle object of this invention to provide a ball-and-socket-like pivot connection at each one-quarter wire cubicle element corner on its adjacent spider support arm.

it is a further object to hve such a pivot connection by means of a corner pivot connecting means, to permit the box-like one-quarter element to move with relation to its adjacent spider supporting arm, and by having a flexible braid circuit wire connection for connecting around such pivot connection corner point, so as to permit any space movement without a breaking of that flexible braid connection.

BRIEF DESCRIPTION OF THE DRAWINGS

FIG. 1 is a perspective of an antenna having my ball-and-socket improvement at each corner of the square Cubicle Quad antenna three elements, with only three bands shown on the one element thereof, though all are similar.

Figure 1:
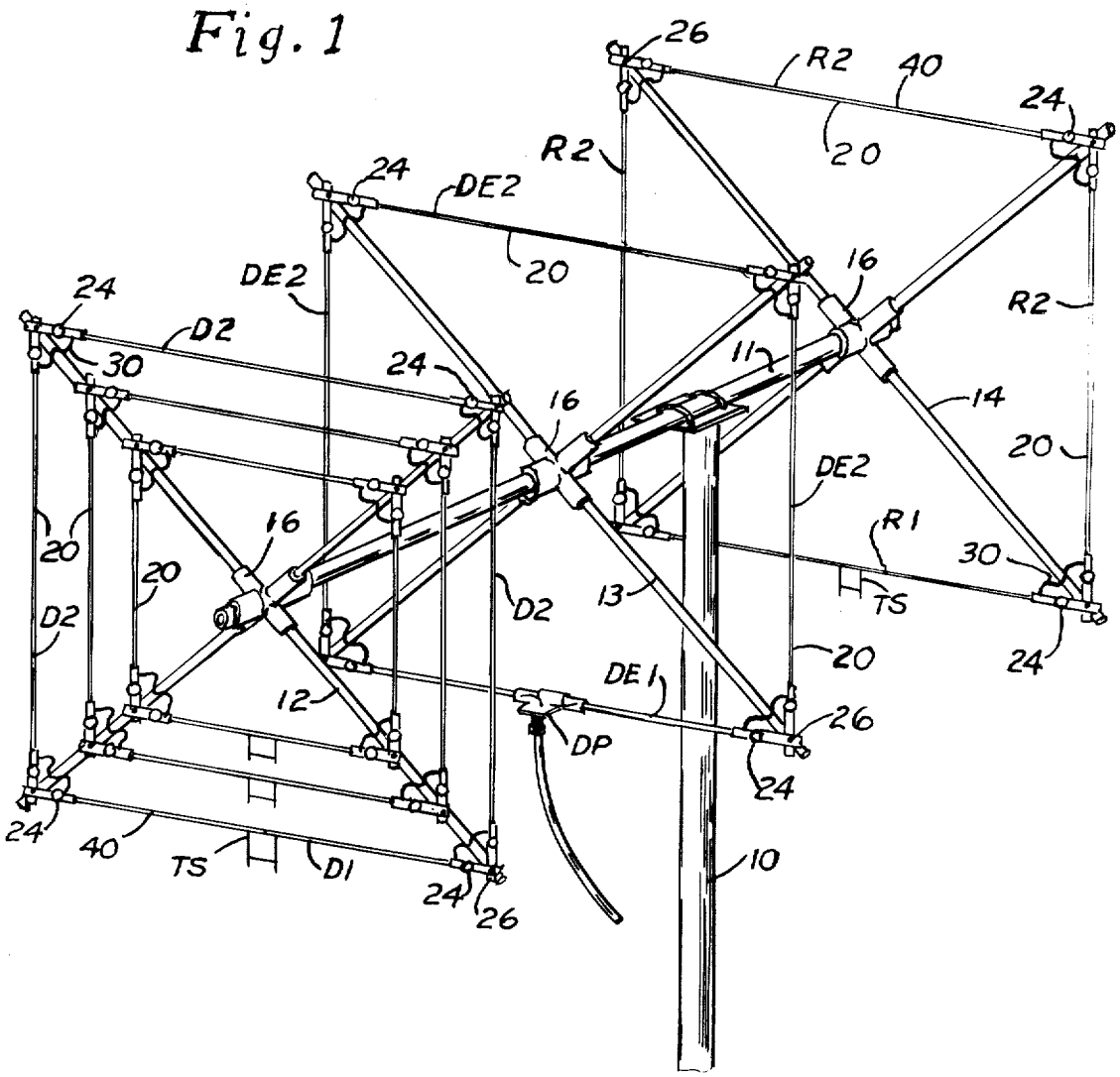

Referring now to the drawings, in which the same characters of reference have been used to designate like or similar parts, 10 represents a vertical mast which is affixed to a building and with the mast adapted conventionally for rotation, as may be desired in connection with the use of the antenna for directionally placing the antenna for transmission or reception purposes. Affixed to the top of the mast is a horizontal rigid boom bar 11. Affixed to that horizontal boom 11 are substantially equally spaced radial spider arms, 12, 13 and 14, each as axial radial arms by suitable conventional means, such as by spokes 16 fixed onto the boom, as illustrated. Each of these elements are conventionally as illustrated and positioned. There are three elements: the Reflector R-1, R-2, R-2, R-2; the Driven Element DE-1, DE-2, DE-2, DE-2; and the Director D-1, D-2, D-2 D-2. These designations are necessary due to the slightly different dimensions of each element, the Director being the smaller of the three elements, the Reflector being the larger and the Driven Element of intermediate dimensions. Obviously, three legs of each element are identical to each other as indicated by duplicate part numbers, D-2, DE-2 and R-2. However, the lower leg in each element, designated as D-1, DE-1, and R-1, differ in design in that each has its embedded copper wire emerge as an external loop at its center. In addition, DE-1 is reenforced by extra fiberglass sheathing and a plate of fiberglass F in its center upon which an SO-239 coaxial chassis fitting DP is installed to provide a feed drive point for r-f energy from the transmitter. The external loops of the copper wire in the center of D-1 and R-1 provide attach points for tuning stubs with which the elements may be resonated exactly.

As explained, heretofore the wire Cubicle Quad elements, of one-quarter wavelength at resonant frequency, each together comprised one complete full wave element on and extending from each spider arm in a square peripheral arrangement, was fixedly secured to a peg or other attachment means at the corner junction on the spider arm. Thus heretofore any vibration in the entire antenna was transmitted to those corner connections of those elements on the spider arms, causing the wire bands to move or bend, and in time that movement caused a fatigue weakening and eventual breaking of those band wires at each of its said corners.

Figure 2:
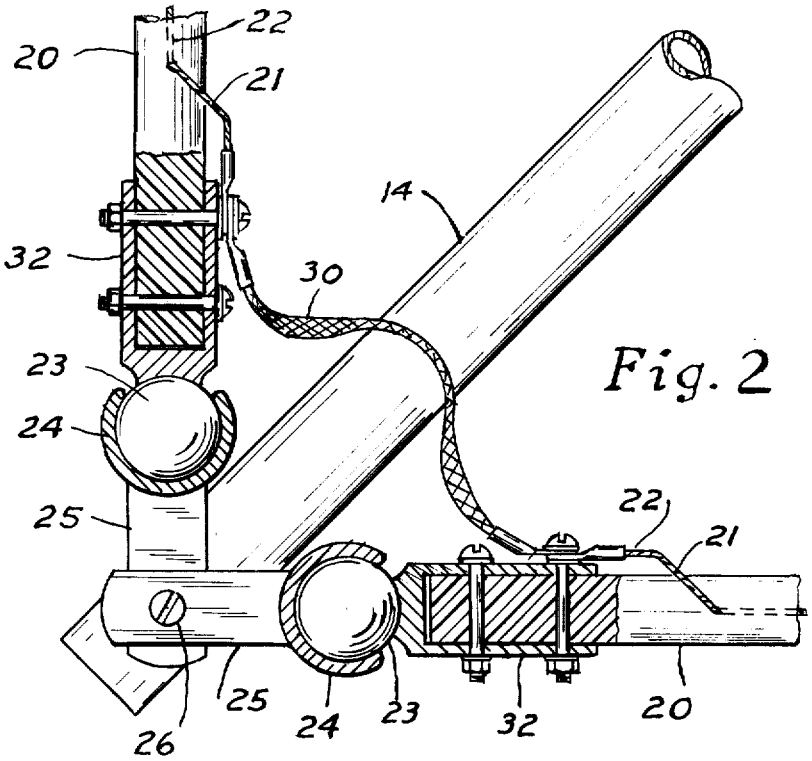
FIG. 2 is an enlarged partial view of one of the element corners showing my novel ball-and-socket pivot connections of each of my wire rod elements, for securing element corners to a spider arm.
Figure 4:
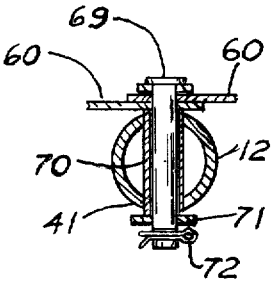
FIGS. 3 and 4 are enlarged partial elevation and cross-section respective views of a modified corner pivot band connecting means.

My antenna is not designed for any special frequency, however it is capable of use with a 20 meter on up frequency. I use a hollow fiberglass rod 20 of about a ⅜ths inch outside diameter for each one-quarter element wire portion and extend the stranded one-quarter band length wire 22 through that hollow rod. That wire is extended outwardly of that hollow rod at 21 just short of the rod ends and at each end as shown. To each of those extended wire 22 ends I affix an electrical terminal member. That fiberglass hollow rod 20 is flexible of conventional construction. I provide the novel way of securing that fiber rod with its embedded wire band to the spider arms. Namely, I provide a suitable material U-shaped retaining hardware member 32 bolted onto each end of that fiber arm 20 as shown. As an integral part of that retaining hardware I have a ball 23 extending in longitudinal alignment with the rod 20 to which affixed. There is one of those at each end of each fiber rod 20. Each of the balls are of suitable material, such as stainless steel, and is pressed into a spring-tension stainless steel socket member 24 for a tight pivot clasping and holding of each ball by its socket. Each socket 24 has an extension neck 25 which is fixedly secured to a spider arm in longitudinal alignment with its rod 20. Each of the four one-quarter elements are so constructed and so secured to a spider spoke 14 as by a suitable bolt means 26, to form one quad element. As shown in FIG. 1, there are four such one-quarter wire-fiberglass rod carried element portions secured to a four arm spider, such as to 12 on the boom 11, so as to form the square element 40. To complete the electrical circuit, each of the 16-gauge stranded copper wires of each rod 20 are interconnected by a tinned copper braided flexible wire 30, as shown in FIG. 2, by the extended terminal adjacent ends of each wire 22 being interconnected thereby. Each end of the braided wire 30 has an electrical terminal which is secured in circuit with an adjacent wire 22 end by one of the clamping bolts of its adjacent U member 32 of the fiber arm and is held in place thereon. The U clamps 32 at each end of the fiberglass arms are also preferrably of a non-conductive material, such as of polyurethane or some other suitable strong plastic. The electrical circuit of the four square one-quarter wire element is interconnected by those corner braided wires 30 at each square corner.

While I have illustrated and explained my FIG. 2 construction of one corner attachment of a cubicle element on my spider arm, it is to be understood that all four corners of a single element are identical as shown and just described. There are usually three substantially aligned and spaced varied size square elements, and usually three sets of such elements of the antenna on the horizontal boom 10, as illustrated, though I only show a three element one, as the Director bands D-1, D-2, D-2 and D-2 element.

Sockets 24 are usually stationarily held by its arm attachment bolt 26 to a spider arm in right angle solid attachment arrangement thereon and with relation to each other, though that could be a pivot connection 26 instead of a fixed point one. It is to be understood that a corner pair of those sockets and arms 24, 25 could be made as one solid unit of right angle configuration, rather than as two separate units, with the arms 25 of such a pair secured to the corner point of attachment to a spider supporting arm. My ball-and-socket attachments, 23–24, during wind or other caused vibration, permit the hollow fiberglass rods 20 to flex laterally or otherwise to move according to, such as, the wind velocity, by one or more of its balls 23 being moved in its respective socket. Each corner strap 30 is about twice as long as needed, so as to allow for a six directional possible wind caused movement of a one-quarter element rod-wire 20 at each element corner with relation to its adjacent corner element quarter piece. Because of such ball-and-socket connection pivoting and the flexible copper braided longer than needed interconnecting circuit strap 30, extending loosely between adjacent terminals of adjacent ends of the stranded copper wire of each fiberglass rod 20, at each element corner, there is no resultant breaking by the antenna of its entire cubicle wire elements and at its corner straps 30 during such vibration movement.

My novel ball-and-socket construction, as just explained and illustrated in FIG. 2, at each end of each fiber rod-wire 20, comprises a pivot means for securing each end of each fiberglass rod to the spider support arm, for permitting a wind or other caused flexing six directional movement of the antenna element and its fiberglass band wire encased rods at each corner of each four square cubicle element.

Figure 3:
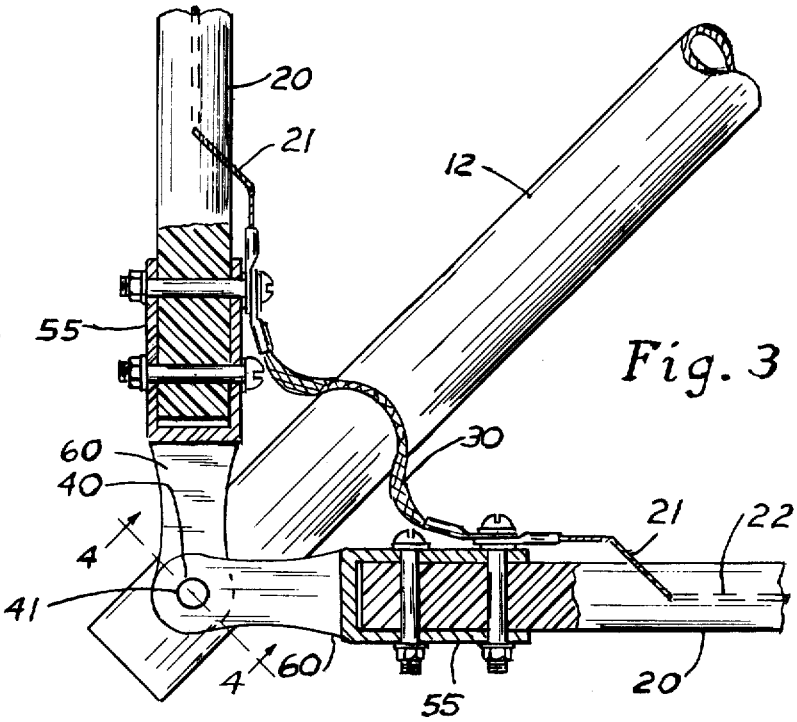
Figure 5:
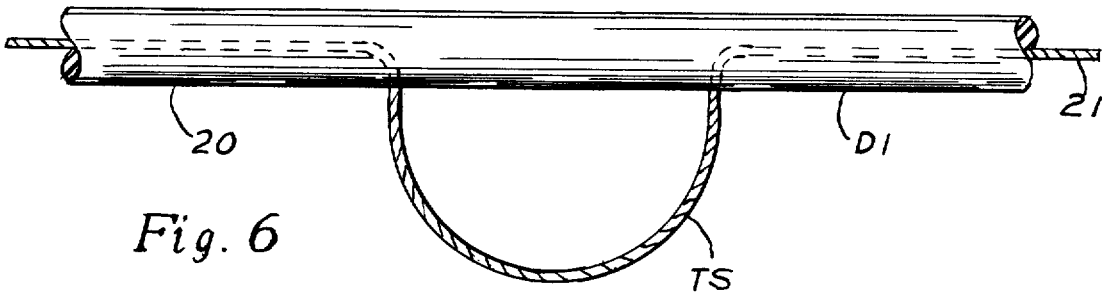
FIG. 5 is enlarged partial view to illustrate the attachment point TS of the tuning stub of the Director and the same of the Reflector elements, D-2 and R-2, respectively.
Figure 6:
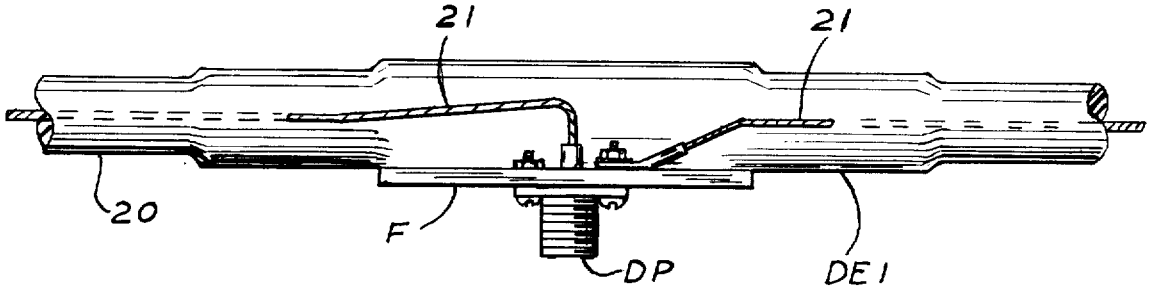
FIGS. 6 and 7 similarly illustrate the drive point DP for an SO-239 coaxial fitting at the lower portion of the driven DE-2 element, for r-f transmitter energy thereto.
Figure 7:
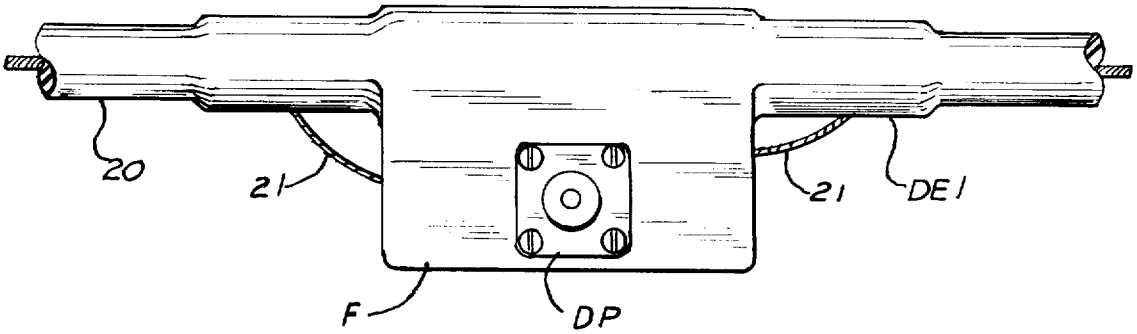

In FIG. 3 I have shown a modification of my teaching of a pivoted connection at each corner of the Cubicle Quad antenna element to the spider arm. Instead of a ball-and-socket arrangement, I extend the retaining hardware clamp 55 in the form of a flat disc 40 having a central opening 41 at its end, in longitudinal alignment with its fiberglass rod at each rod end. A suitable conventional loose stud pivot pin 69 and loose sleeve 70 in 40 is a modified loose pivot holding means, in each of those openings 41 of disc 60, as shown. That loose pivoting permits such pivotally connected element rods 20 to pivotally move in six possible directions thereon and with relation to each other. Clamp 55 of 60 places its disc 40 in longitudinal alignment to an end of its rod 20, at each rod end. A cotter pin 72 through the pin 69 holds a washer 71 loosely below sleeve 70 as shown as a loose pivot. This permits a multi-wind caused pivotal movement of each one-quarter element wire-rod 20 at its disc 40 on a loose pivot pin 69, within the teaching of my invention. In this modification, as before, I interconnect the terminal ends of the stranded copper wire of each corner adjacent fiberglass rod four elements at each corner by a longer than needed flexible braided tinned copper wire 30 of sufficient length to permit a movement, therebetween as before, as may be necessary, without a breaking of the wires 30, and thus completing the circuit of the four square element.

Having thus explained and described my novel pivot means corner securement construction for wire element of a Quad Cubicle antenna onto a set of spider arms, where each corner is secured onto a spider support arm, it will be seen that many changes and modifications can be made therein without deviating from the spirit, teaching and scope of this invention. Therefore, I wish to be bound only by the hereunto appended claims.

What I claim and desire to secure by Letters Patent is:

1. In combination with a Cubicle Quad antenna having a vertical mast, a horizontal boom secured to the mast, a four spoke radial spider arm secured to the boom, and a cubicle wavelength antenna wire element extending from spider arm to spider arm in a box-like configuration, with each one-fourth portion of said wire element between spider arms being enclosed within a semirigid non-conductive material rod and with each end of said wire extending outwardly of its rod adjacent its rod end, the combination therewith of a ball-and-socket joint connection means in longitudinal rod extension at each end of each rod, with one of either the ball or the socket of said means being secured to a spider arm and the other thereof being secured to the adjacent end of the rod, and a loosely spanned braided circuit wire connection extending between each adjacent wire end at each corner of the cubicle element, with said ball-and-socket connecting means comprising pivot means for permitting free pivotal movement of the antenna element when caused by wind.

2. In combination, a Cubicle Quad wire antenna element comprising one wavelength of four wire element portions each adapted to be secured at each of its cubicle corners to a radial spider support arm of a horizontal boom carried by a vertical mast, with each wire of the cubicle wire element being carried by a non-conductive rod means and having its wire ends exposed adjacent each of its rod ends, a pivot-like connecting means carried by each of said rod means ends and associated with a spider arm for connecting each rod means end to its adjacent spider support arm, and a loose spanned wire circuit connecting means extending from and loosely connecting adjacent ends of each cubicle rod means wire element portions adjacent each corner, whereby a wind or weather caused possible directional movement of the antenna elements with relation to the spider arms may occur as a result of said pivot-like connection means.

3. In combination with a plural element antenna having a vertical mast, a horizontal boom secured to the mast, a plural spoke radial spider arm secured to the boom, and a wave length antenna wire element extending from spider arm to spider arm, with each portion of said wire elements between spider arms being enclosed within a non-conductive material supporting rod connected to and extending between a pair of spider arms and with each end of said wire extending outwardly of its supporting rod adjacent its respective rod end, the combination therewith of a ball-and-socket joint pivot connection means in longitudinal rod extension at each end of each rod, with one of either the ball or the socket of said rod pivot connection means being secured to a spider arm and the other thereof being secured to the adjacent end of an element supporting rod, and a loosely spanned bendable circuit wire connection extending between each adjacent wire element end at each element corner of the antenna, with said pivot joint connection means of each rod end being adapted for permitting free pivotal movement of a rod element with relation to its adjacent spider arms as caused by any weather or wind condition occurrence.

* * * * *